US010759033B2

(12) United States Patent
Lai et al.

(10) Patent No.: US 10,759,033 B2
(45) Date of Patent: Sep. 1, 2020

(54) FASTENER DRIVING TOOL

(71) Applicant: Pao Shen Enterprises Co., Ltd., Chang Hua (TW)

(72) Inventors: Chun-Man Lai, Chang Hua (TW); Sheng-Lung Yeh, Chang Hua (TW)

(73) Assignee: Pao Shen Enterprises Co., Ltd., Chang Hua (TW)

( * ) Notice: Subject to any disclaimer, the term of this patent is extended or adjusted under 35 U.S.C. 154(b) by 285 days.

(21) Appl. No.: 15/996,583

(22) Filed: Jun. 4, 2018

(65) Prior Publication Data

US 2019/0240823 A1 Aug. 8, 2019

(30) Foreign Application Priority Data

Feb. 2, 2018 (TW) ..... 107103776 A

(51) Int. Cl.
*B25C 5/00* (2006.01)
*B25C 5/11* (2006.01)

(52) U.S. Cl.
CPC ..... *B25C 5/11* (2013.01)

(58) Field of Classification Search
CPC ..... B25C 5/11; B25C 5/00
See application file for complete search history.

(56) References Cited

U.S. PATENT DOCUMENTS 3,610,505 A * 10/1971 Males ..... B25C 5/10 227/127
4,126,260 A * 11/1978 Mickelsson ..... B25C 5/10 227/132
4,452,388 A * 6/1984 Fealey ..... B25C 5/16 227/120
5,131,580 A * 7/1992 Allman ..... B25C 1/02 227/132
5,335,839 A * 8/1994 Fealey ..... B25C 5/06 227/132
5,664,722 A * 9/1997 Marks ..... B25C 5/085 227/132
6,145,728 A * 11/2000 Marks ..... B25C 5/11 227/120
7,097,086 B2 * 8/2006 Joyce ..... B25C 5/0242 227/120
7,121,444 B2 * 10/2006 Joyce ..... B25C 5/0242 227/132

(Continued)

FOREIGN PATENT DOCUMENTS

TW 545350 8/2003

*Primary Examiner* — Praachi M Pathak
(74) *Attorney, Agent, or Firm* — Burris Law, PLLC

(57) ABSTRACT

A fastener driving tool includes a striking member and an energy storing unit disposed in a housing. The energy storing unit has at least one torsion spring having forwardly extending short and long legs which are connected to a pivotable handle and the striking member. An anchoring member is disposed forwardly of and slidable relative to the handle and is detachably engaged with the striking member. During a pivotal movement of the handle, the short and long legs of the torsion spring are moved in opposite directions to store a biasing energy and to force the striking member upwards, which in turn moves the striking member downward for performing a fastener striking stroke once the anchoring member is disengaged from the striking member to release the torsion spring.

10 Claims, 20 Drawing Sheets

(56) References Cited

U.S. PATENT DOCUMENTS

| | | | | |
|---|---|---|---|---|
| 7,540,400 | B2 * | 6/2009 | Zins | B25C 1/008 227/108 |
| 7,665,644 | B2 * | 2/2010 | Hu | B25C 5/11 227/132 |
| 7,681,771 | B2 * | 3/2010 | Kandasamy | B25C 5/0242 227/120 |
| 7,942,298 | B2 * | 5/2011 | Kandasamy | B25C 5/0242 227/120 |
| 8,074,854 | B2 * | 12/2011 | Hu | B25C 5/11 227/130 |
| 8,978,952 | B2 * | 3/2015 | Marks | B25C 5/0235 227/132 |
| 9,770,819 | B2 * | 9/2017 | Lam | B25C 5/13 |
| 2008/0223902 | A1 * | 9/2008 | Tsai | B25C 5/11 227/134 |
| 2011/0297725 | A1 * | 12/2011 | Huang | B25C 5/11 227/120 |
| 2012/0181320 | A1 * | 7/2012 | Wang | B25C 5/1658 227/109 |
| 2013/0133906 | A1 * | 5/2013 | Huang | B25C 5/11 173/18 |
| 2016/0059400 | A1 * | 3/2016 | Wang | B25C 5/11 227/8 |
| 2017/0266799 | A1 * | 9/2017 | Wang | B25C 5/11 |
| 2019/0047130 | A1 * | 2/2019 | Lai | B25C 5/06 |

* cited by examiner

FASTENER DRIVING TOOL

CROSS-REFERENCE TO RELATED APPLICATION

This application claims priority of Taiwanese Patent Application No. 107103776, filed on Feb. 2, 2018.

FIELD

The disclosure relates to a hand-held fastener driving tool, and more particularly to a fastener driving tool using a torsion spring unit for urging a fastener.

BACKGROUND

Referring to FIGS. 1 and 2, a conventional spring actuated fastener driving tool 1 as disclosed in Taiwanese Patent Publication No. 545350 includes a housing 11, a nail striking unit 12 and a handle unit 13. The housing 11 has a central shaft 111. The nail striking unit 12 has a striking member 121 mounted in a front portion of the housing 11 for reciprocal movement in an upper-and-lower direction, and a leaf-spring 122 disposed in the housing 11 and connected at a front end to the striking member 121. The handle unit 13 has a handle 131 pivotably mounted to the central shaft 111, and a compressible spring 132 disposed in the housing 11 to be compressed to produce a biasing force to the handle 131. The handle 131 is engageable with the striking member 121 at a front end thereof.

When the handle 131 is pivoted about the central shaft 111 by a manual press force applied on a rear end thereof to move the striking member 121 upwardly, the leaf-spring 122 is resiliently deflected and loaded. Then, a successive pivot movement of the handle 131 results in disengagement thereof from the striking member 121, and at this moment the leaf spring 122 is thus freed to resiliently return the striking member 121 downwardly to eject a fastener.

However, during pivot movement of the handle 131, the leaf-spring 122 must be resiliently deflected by a relatively long distance to accumulate a sufficient biasing energy. Thus, a large operating effort is required to move the striking member 121 for the long distance to bend the leaf-spring 122 to a sufficient degree.

SUMMARY

Therefore, an object of the disclosure is to provide a fastener driving tool which has a simple construction that is operable with less effort.

According to the disclosure, a fastener driving tool includes a housing, a striking member, an energy storing unit and a handle unit. The housing has two housing halves which are matingly engaged with each other to define a housing space, a pivot axle which is disposed in the housing space, and a fastener striking opening at a bottom of a forward end of the housing. The striking member is mounted in the housing for reciprocal movement in an up-and-down direction. The striking member has a lower striking end which faces the fastener striking opening, and an upper driven end which is formed with an engaged slot. The energy storing unit is disposed in the housing space, and includes an energy storing assembly which has at least one torsion spring that is twistable about a fixed axle disposed rearwardly of the pivot axle. The torsion spring has a short leg and a long leg which extend tangentially and forwardly. The long leg extends beyond the short leg to engage with the striking member. The energy storing unit further includes a return spring which is disposed downwardly of the short leg to be compressed by the short leg to store a return energy. The handle unit includes a handle having a front pivot end which is pivotably mounted in the housing space and on the pivot axle, a rear effort end which is opposite to the front pivot end, and a forcing portion which is interposed between the front pivot end and the rear effort end and which is disposed to force the short leg to move downwardly when the rear effort end is turned about the pivot axle. The handle unit further includes an anchoring member which is slidably mounted to the front pivot end of the handle and which has a forward anchoring portion that projects forwardly of the front pivot end to be engaged in the engaged slot of the striking member, and a biasing member which is disposed to bias the anchoring member forwardly. The handle is pivotally movable relative to the pivot axle from a ready position, where the lower striking end of the striking member is in close proximity to the fastening striking opening, and the forward anchoring portion of the anchoring member is engaged in the engaged slot, through an intermediate position, where, via an abutting engagement of the forcing portion with the short leg, the short leg is moved downwardly to compress the return spring to generate the return energy, and where the anchoring member is moved with the handle for being brought upwardly and rearwardly to engagingly move the striking member and the long leg of the torsion spring upwardly to gradually increase a loading of the torsion spring for the striking member, to a striking position, where the anchoring member is disengaged from the engaged slot of the striking member, and the torsion spring is freed to release a biasing energy to move the striking member downward toward the fastener striking opening. During a pivotal movement of the handle from the striking position to the ready position, the return spring is freed to release the return energy to urge the energy storing assembly upwardly and to cause the pivot movement of the handle and the anchoring member about the pivot axle and an upward movement of the long leg and the striking member to make a sliding engagement of the striking member with the forward anchoring portion of the anchoring member in the up-and-down direction, while the biasing member is loaded to accumulate a biasing force that urges the anchoring member to be engaged in the engaged slot.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
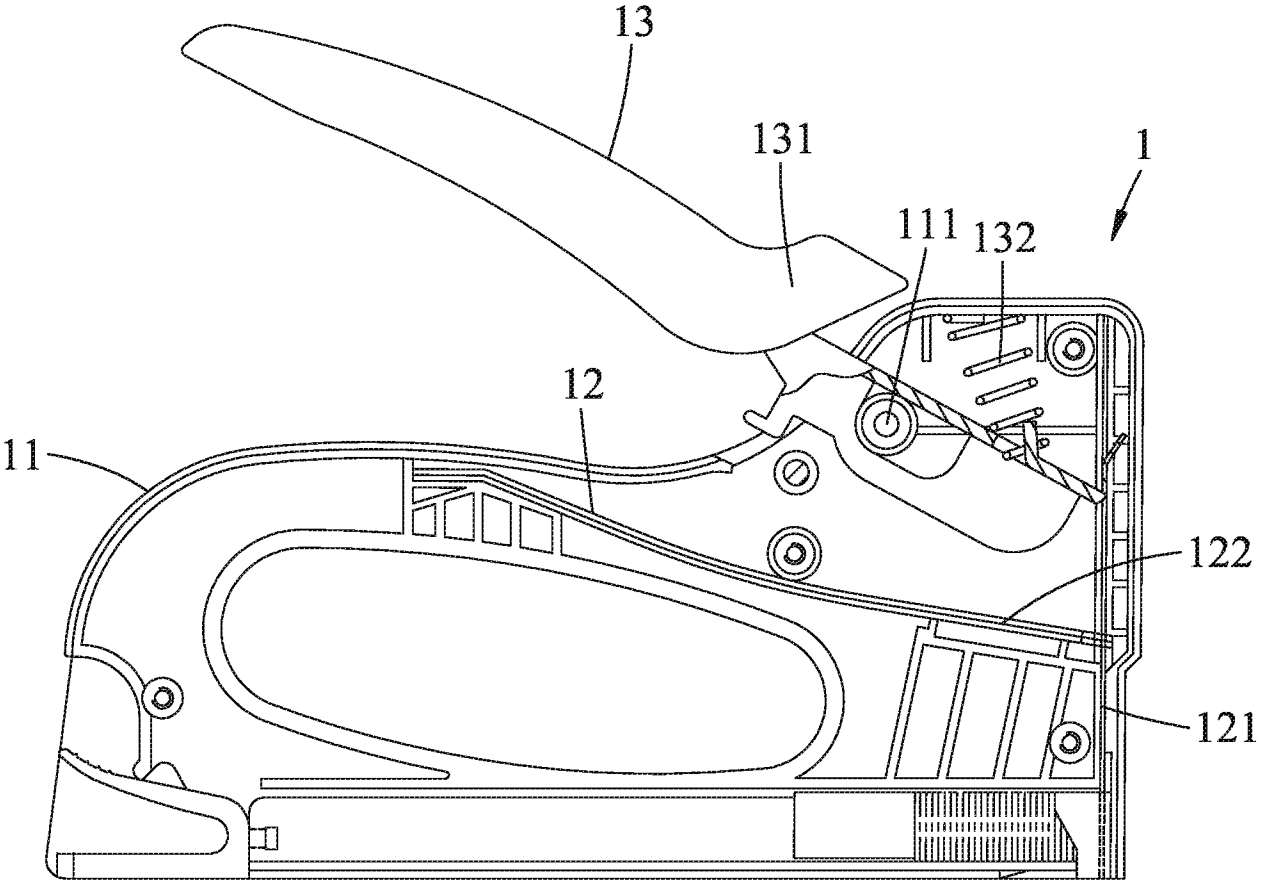
FIG.1 PRIOR ART
FIG. 1 is a schematic partly-sectioned view of a conventional spring actuated fastener driving tool.
Figure 2:
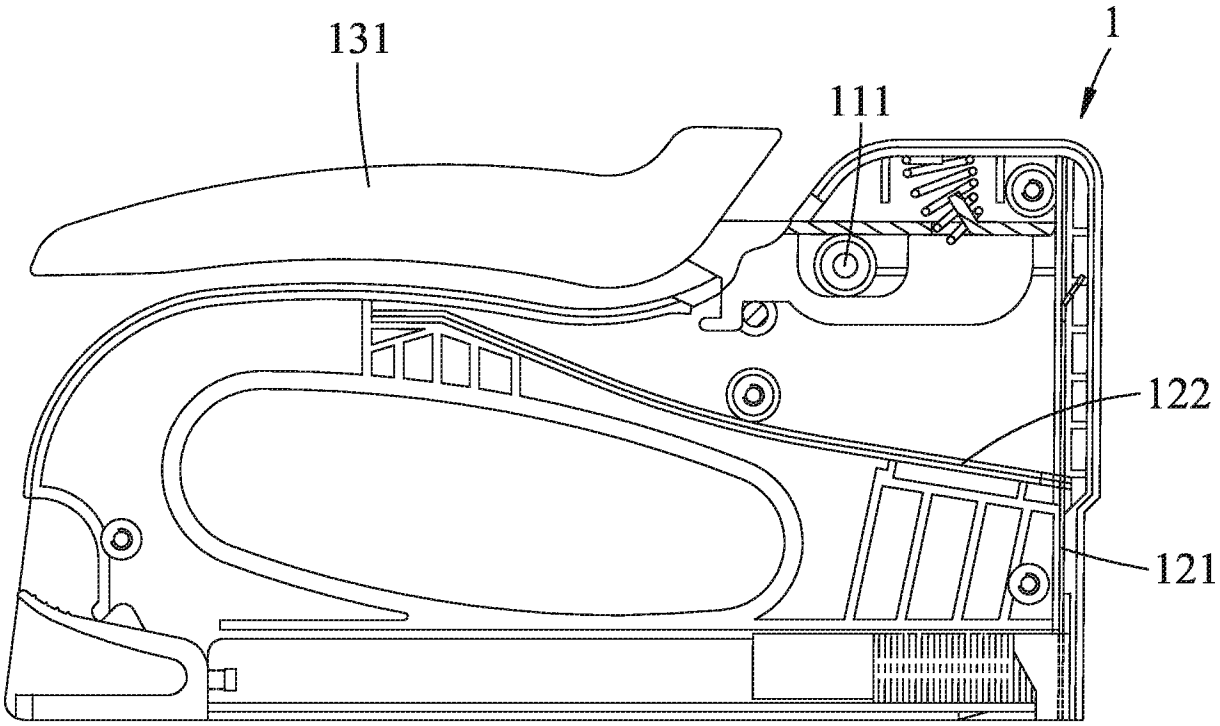
FIG.2 PRIOR ART
FIG. 2 is a schematic partly-sectioned view of the conventional fastener driving tool illustrating a state where a handle is pressed.

Before the disclosure is described in greater detail, it should be noted that where considered appropriate, reference numerals or terminal portions of reference numerals have been repeated among the figures to indicate corresponding or analogous elements, which may optionally have similar characteristics. In the following description, the directions, such as "front-and-rear direction (X)", "left-and-right direction (Y)" and "up-and-down direction (Z)", indicate the orientations of the embodiment in use.

Figure 3:
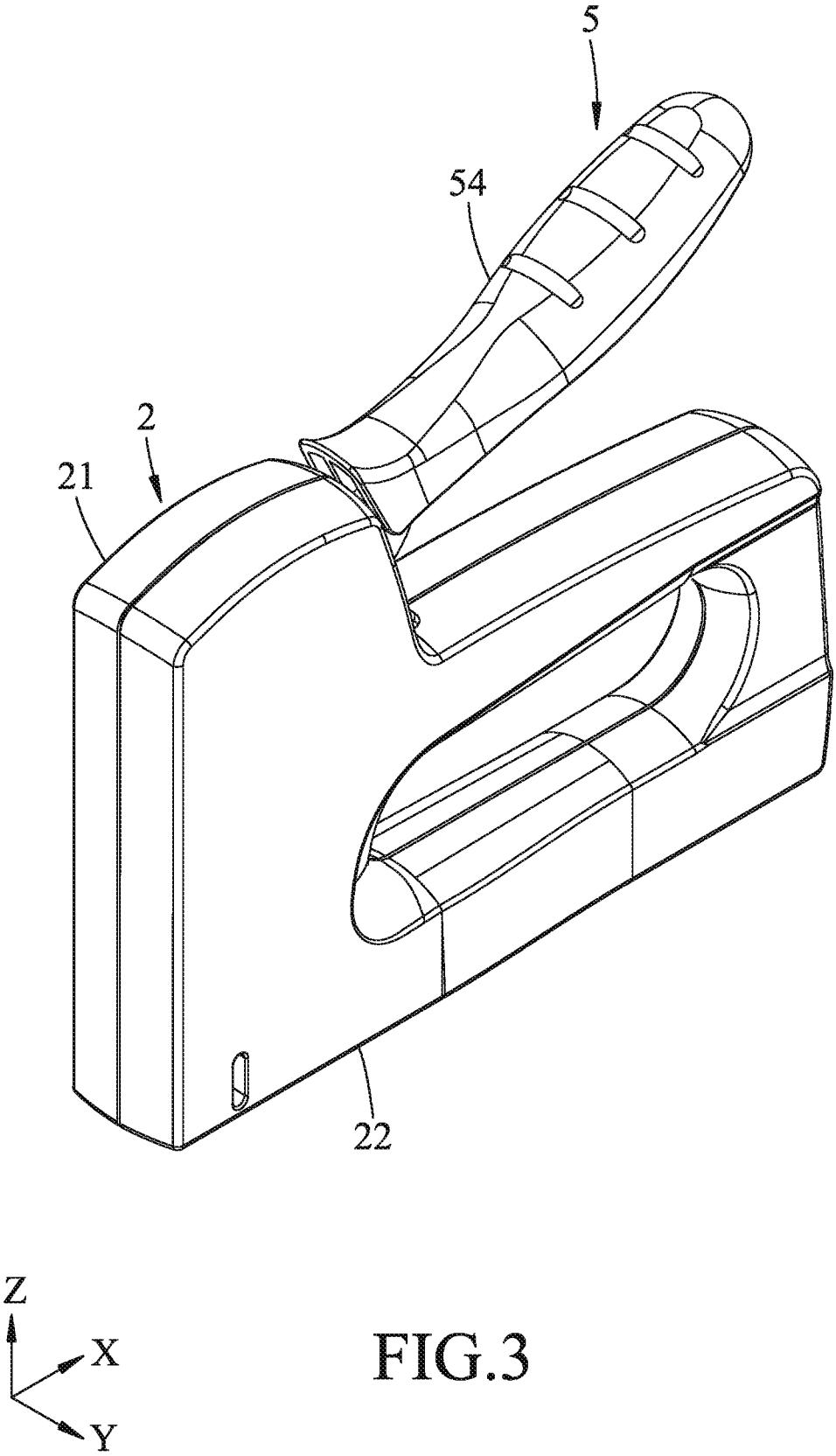
FIG. 3 is a perspective view illustrating an embodiment of a fastener driving tool according to the disclosure.
Figure 4:
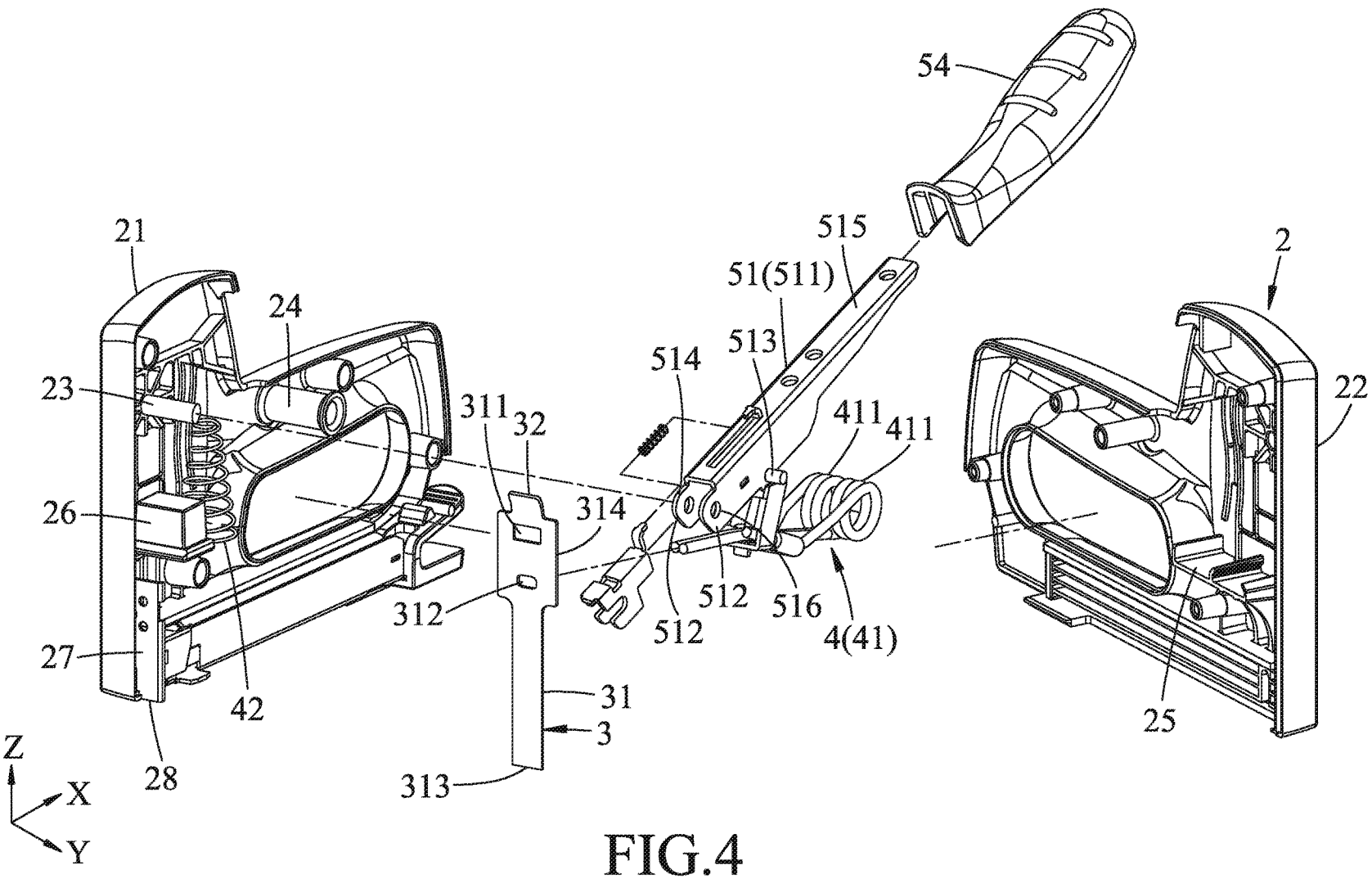
FIG. 4 is an exploded perspective view illustrating a portion of the embodiment.
Figure 5:
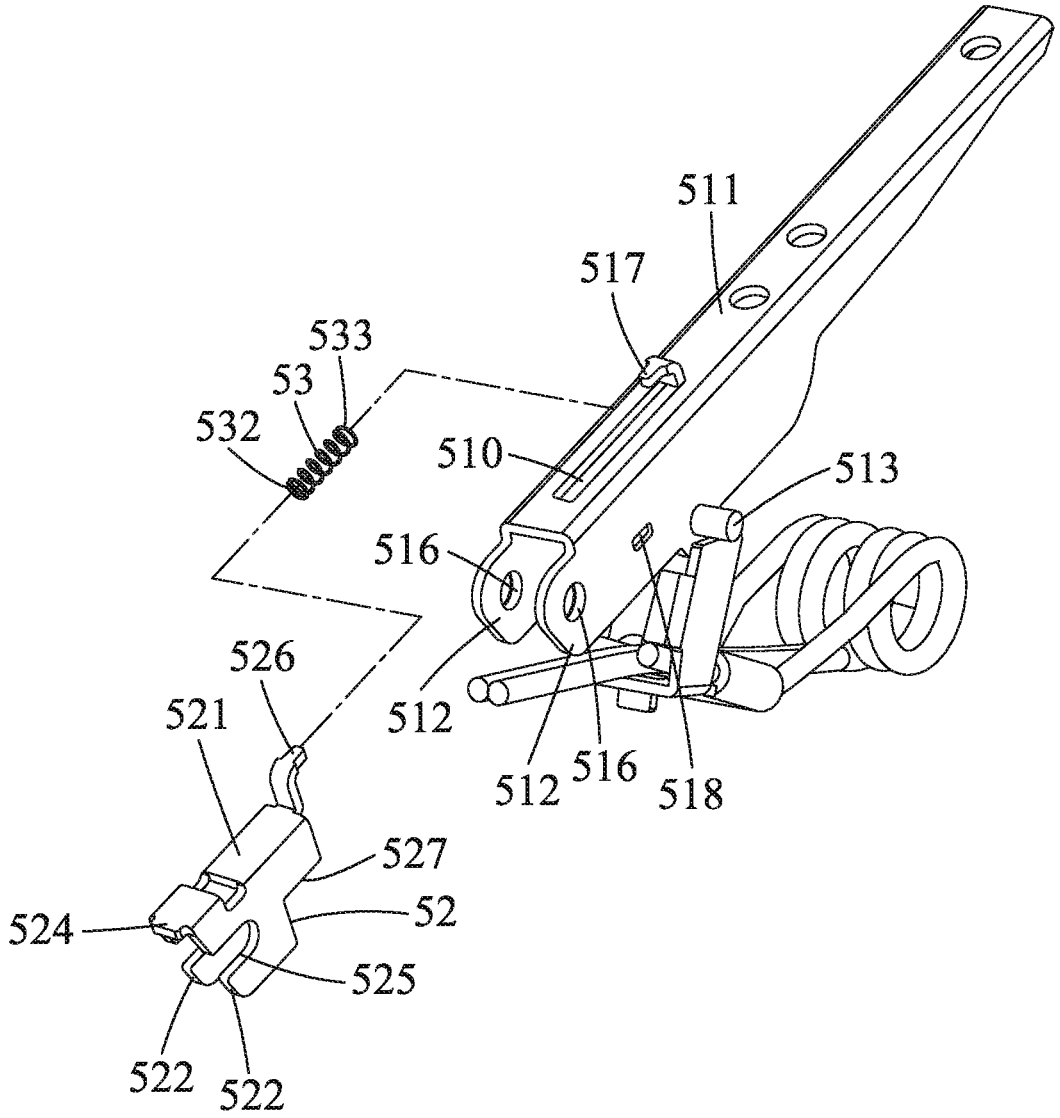
FIG. 5 is a close-up exploded perspective view illustrating a handle unit of the embodiment.

Referring to FIGS. 3 and 4, an embodiment of a fastener driving tool according to the disclosure is shown to include a housing unit 2, a striking member 3, an energy storing unit 4 and a handle unit 5.

With reference to FIGS. 4 to 8, the housing 2 has two housing halves 21, 22 which are matingly engaged with each other to define a housing space, a pivot axle 23 which is disposed in the housing space and extends in a left-and-right direction (Y), a fixed axle 24 which is detachably disposed in the housing space and located rearwardly and downwardly of and parallel to the pivot axle 23, a spring bracket 25 which is disposed in the housing space adjacent to a forward end of the housing halves 21, 22, a stop 26 which is disposed on and extends forwardly of the spring bracket 25, a guiding member 27 which is disposed in a lower and forward end of the housing space to define a striking track 271 in an up-and-down direction (Z), and a fastener striking opening 28 which is located at a bottom of a forward end of the housing 2 and formed at a lowermost end of the striking track 271.

The striking member 3 is mounted in the housing space for reciprocal movement along the striking track 271. The striking member 3 includes an elongated plate body 31 having a lower striking end 313 which faces the fastener striking opening 28, and an upper driven end 314 which extends upwardly of the lower striking end 313 and which is formed with an engaged slot 311 and a connected slot 312 below the engaged slot 311. The striking member 3 further includes a sliding member 32 extending upwardly from and deflected forwardly of the upper driven end 314.

The energy storing unit 4 is disposed in the housing space, and includes an energy storing assembly 41 and a return spring 42. The energy storing assembly 41 has two torsion springs 411 which respectively have coils 413 sleeved around the fixed axle 24 to be twistable about the fixed axle 24 and arranged in the left-and-right direction (Y), and each of which has a short leg 414 and a long leg 415 that extend tangentially and forwardly from the respective coil 413 in a front-and-rear direction (X). The long leg 415 extends forwardly beyond the short leg 414 to be engaged in the connected slot 312 of the striking member 3.

The energy storing assembly 41 further has an adaptor 412 fixedly connected to the short legs 414 of the torsion springs 411. The adaptor 412 has a base wall 416 which is disposed under the torsion springs 411 and on an upper major surface of which the short legs 414 of the torsion springs 411 are placed, two side walls 417 which extend upwardly from a periphery of the base wall 416 to terminate at upwardly facing edges 410 and which are spaced apart from each other in the left-and-right direction (Y), two retaining protrusions 4171 which extend inwardly toward each other from front ends of the side walls 417, respectively, to cooperate with the base wall 416 to retain the short legs 414 therebetween, two stabilizing portions 418 which extend upwardly from the periphery of the base wall 416 and which are spaced apart from each other in the left-and-right direction (Y) and rearwardly of the side walls 417, and a lower protrusion 419 which extends downwardly from the base wall 416 and on which an end of the return spring 42 is connected. The stabilizing portions 418 are configured to firmly retain middle sections of the short legs 414 of the torsion springs 411. In this embodiment, the adaptor 412 is formed from a metal material as an integral single piece to have the side walls 417, the stabilizing portions 418 and the lower protrusion 419 bent from the base wall 416. In assembly, the coils 413 of the torsion springs 411 are firstly sleeved around the fixed axle 24. The adaptor 412 is then attached to the torsion springs 411. Next, the fixed axle 24 is mounted to the housing halves 21, 22 with the retaining protrusions 4171 and the stabilizing portions 418 abutting against the front and middle sections of the short legs 414 of the torsion springs 411 so as to firmly retain the short legs 414 to the adaptor 412. In modified examples, the adaptor 412 may have only the stabilizing portions 418 or the retaining protrusions 4171 disposed to retain the short legs 414 of the torsion springs 411.

The return spring 42 is held on the spring bracket 25 and has the end connected to the lower protrusion 419 of the adaptor 412 to be compressed by the short legs 414 of the torsion springs 411 to store a return energy in the up-and-down direction. In this embodiment, the return spring 42 is in the form of a truncated conical compression spring.

With reference to FIGS. 4 to 6 and FIG. 9, the handle unit 5 includes a handle 51, an anchoring member 52, a biasing member 53 and a handle sleeve 54. The handle 51 has a front pivot end 514 which is pivotably mounted in the housing space and on the pivot axle 23, a rear effort end 515 which is opposite to the front pivot end 514 in the front-and-rear direction (X), and a forcing portion 513 which is interposed between the front pivot end 514 and the rear effort end 515 and which is disposed to force the short legs 414 of the torsion springs 411 to move downwardly when the rear effort end 515 is pivoted about the pivot axle 23. Specifically, the handle 51 has an elongated upper wall 511 formed with an elongated slot 510 which extends in the front-and-rear direction (X), two side major walls 512 extending downwardly from the upper wall 511 and spaced apart from each other in the left-and-right direction (Y) so as to define an elongated sliding space therebetween, and an upper connecting member 517 disposed on the upper wall 511. Each of the side major walls 512 has a pivot hole 516 which is formed at a front end thereof to serve as the front pivot end 514 to be sleeved around the pivot axle 23, and a holding protrusion 518 which is disposed rearwardly of the pivot hole 516 and protrudes laterally toward the other one of the side major walls 512. The forcing portion 513 is disposed on each of the side major walls 512 and projects in the left-and-right direction (Y) so as to abut against the upwardly facing edges 410 of the side walls 417 of the adaptor 412 in the up-and-down direction (Z). In this embodiment, the handle 51 is made from a metal plate bent to have the upper wall 511 and the side major walls 512 that project forwardly beyond the upper wall 511 to form the front pivot end 514.

The anchoring member 52 is slidably mounted to the front pivot end 514 of the handle 51 and in the sliding space, and has a forward anchoring portion 524 which projects forwardly of the front pivot end 514 of the handle 51 to be engaged in the engaged slot 311 of the striking member 3, a sliding guide 526 which is received in and slidable along the elongated slot 510 and which has a tip end that projects upwardly of the elongated slot 510 to be opposite to the upper connecting member 517, a forwardly-opened front notched portion 525 which is rotatably sleeved around the pivot axle 23, and a rear abutment portion 527 which is disposed to abut against the holding protrusions 518 of the handle 51. In this embodiment, the anchoring member 52 is formed as a one single piece, and includes a top wall 521 having the forward anchoring portion 524 and the sliding guide 526 at front and rear ends thereof, respectively, and two lateral walls 522 extending downwardly from the top wall 521 and having the front notched portion 525 and the rear abutment portion 527 at front and rear ends thereof, respectively. The biasing member 53 is a compression spring and has two ends 532, 533 which are respectively engaged with the sliding guide 526 and the upper connecting member 517 so as to bias the anchoring member 52 forwardly relative to the handle 51. The handle sleeve 54 is mounted on the handle 51 to cover the rear effort end 515 for offering a comfortable press operation.

Figure 6:
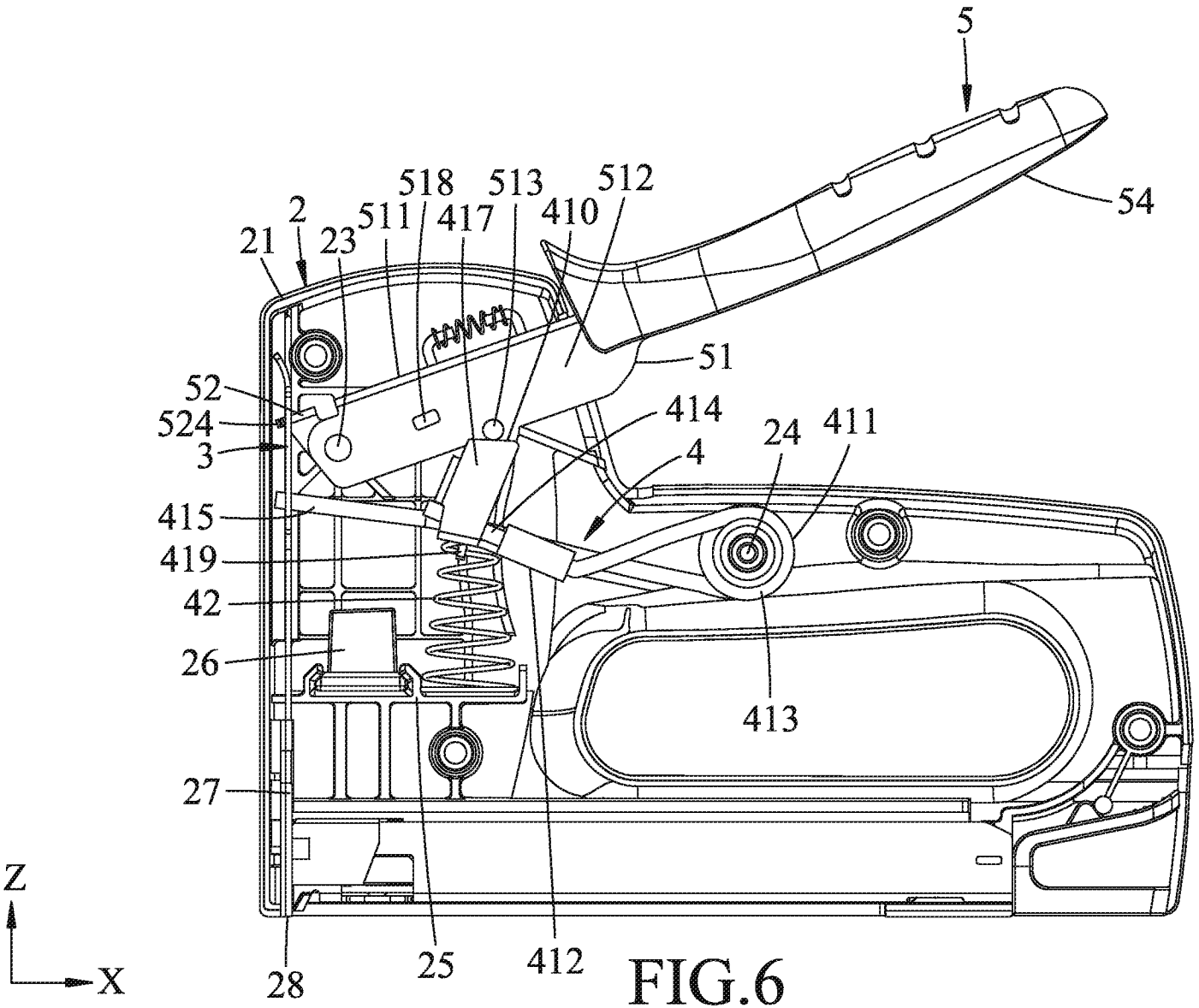
FIG. 6 is a schematic side view of the embodiment, wherein a housing half of the embodiment is removed for the sake of clarity, and wherein a state where a handle of the handle unit is in a ready position is illustrated.
Figure 7:
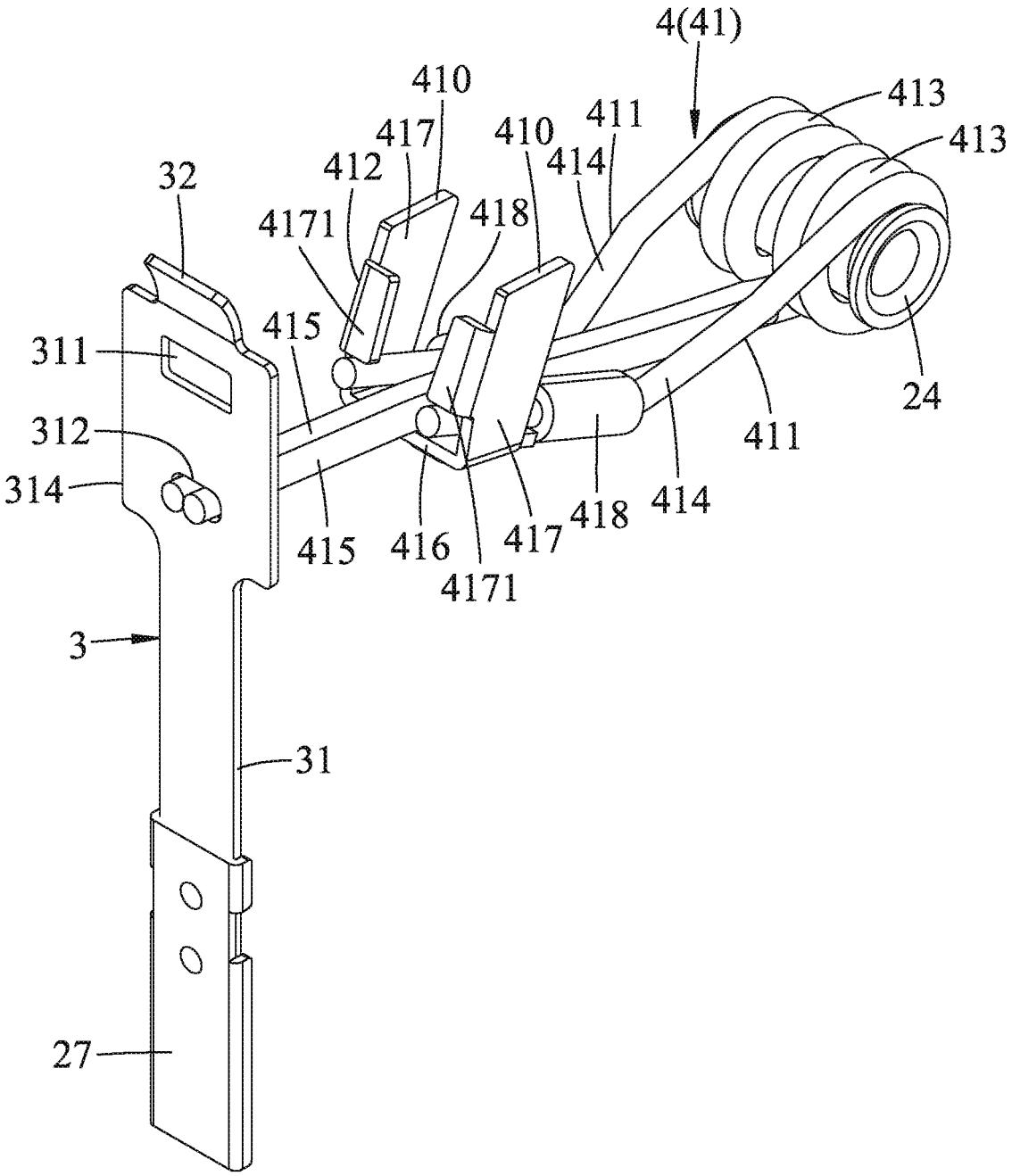
FIG. 7 is a perspective view of a striking member and an energy storing unit of the embodiment.
Figure 8:
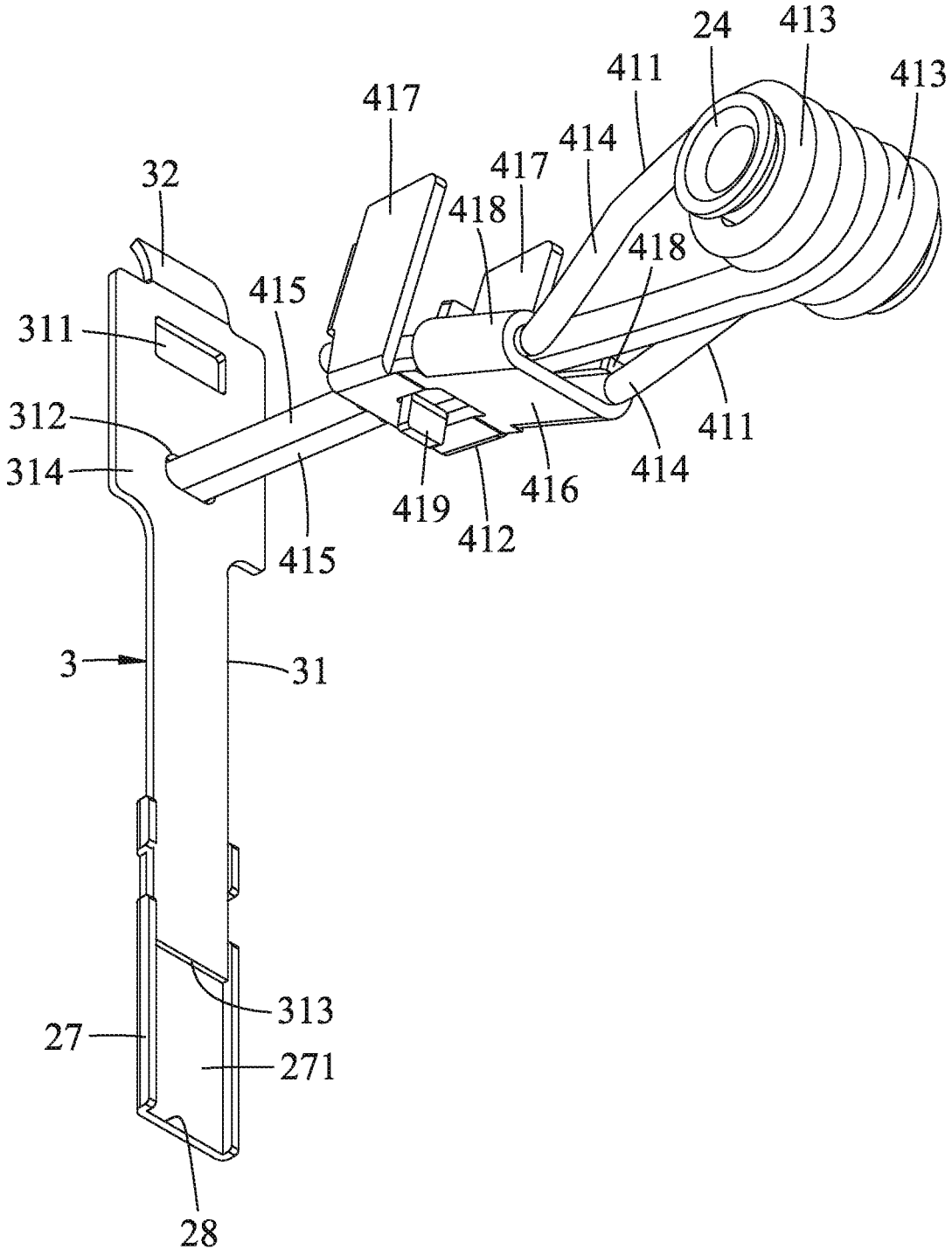
FIG. 8 is a perspective view similar to FIG. 7, but taken from another angle.
Figure 9:
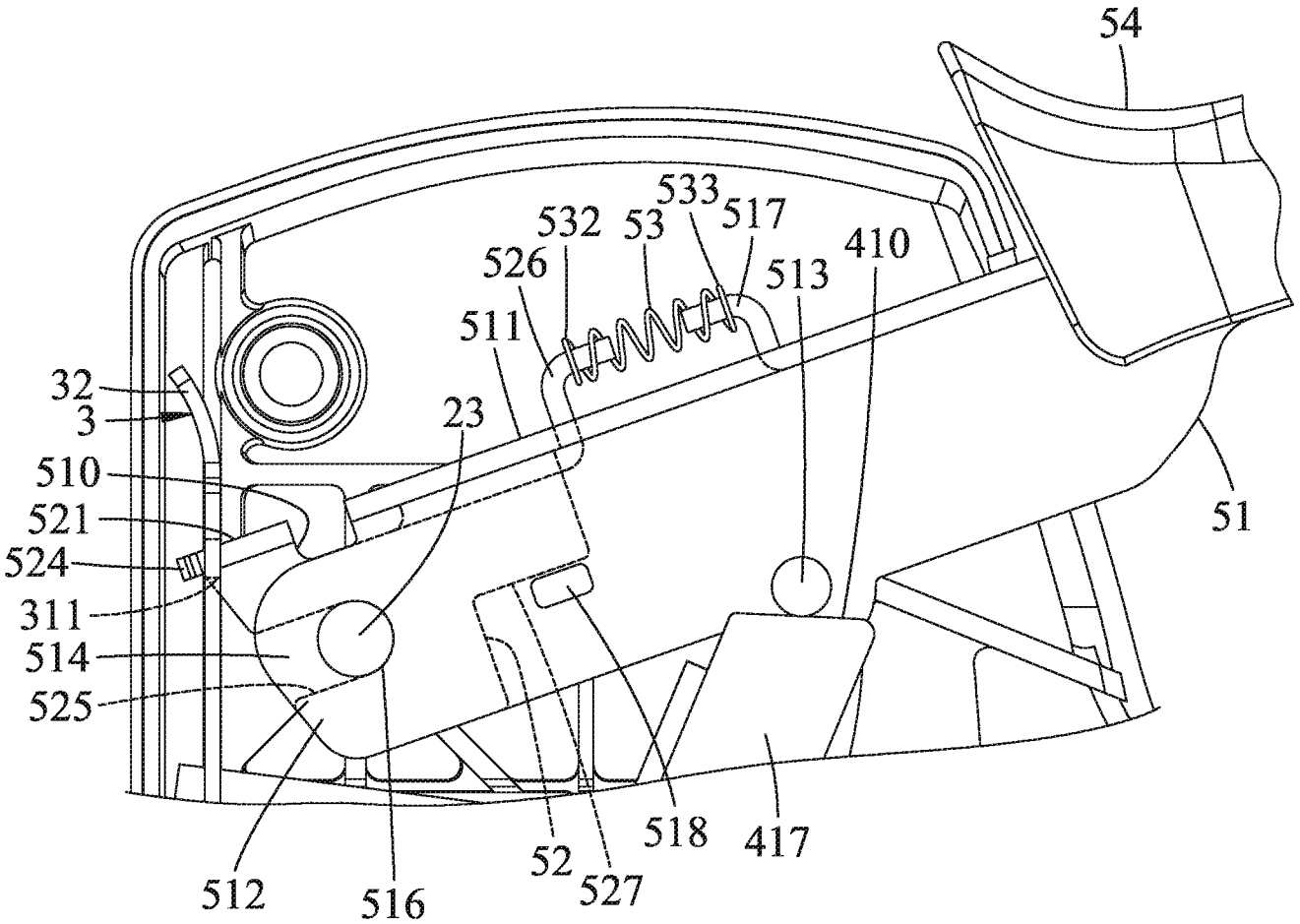
FIG. 9 is a fragmentary, schematic side view of the embodiment, illustrating a state where the handle is in the ready position.
Figure 10:
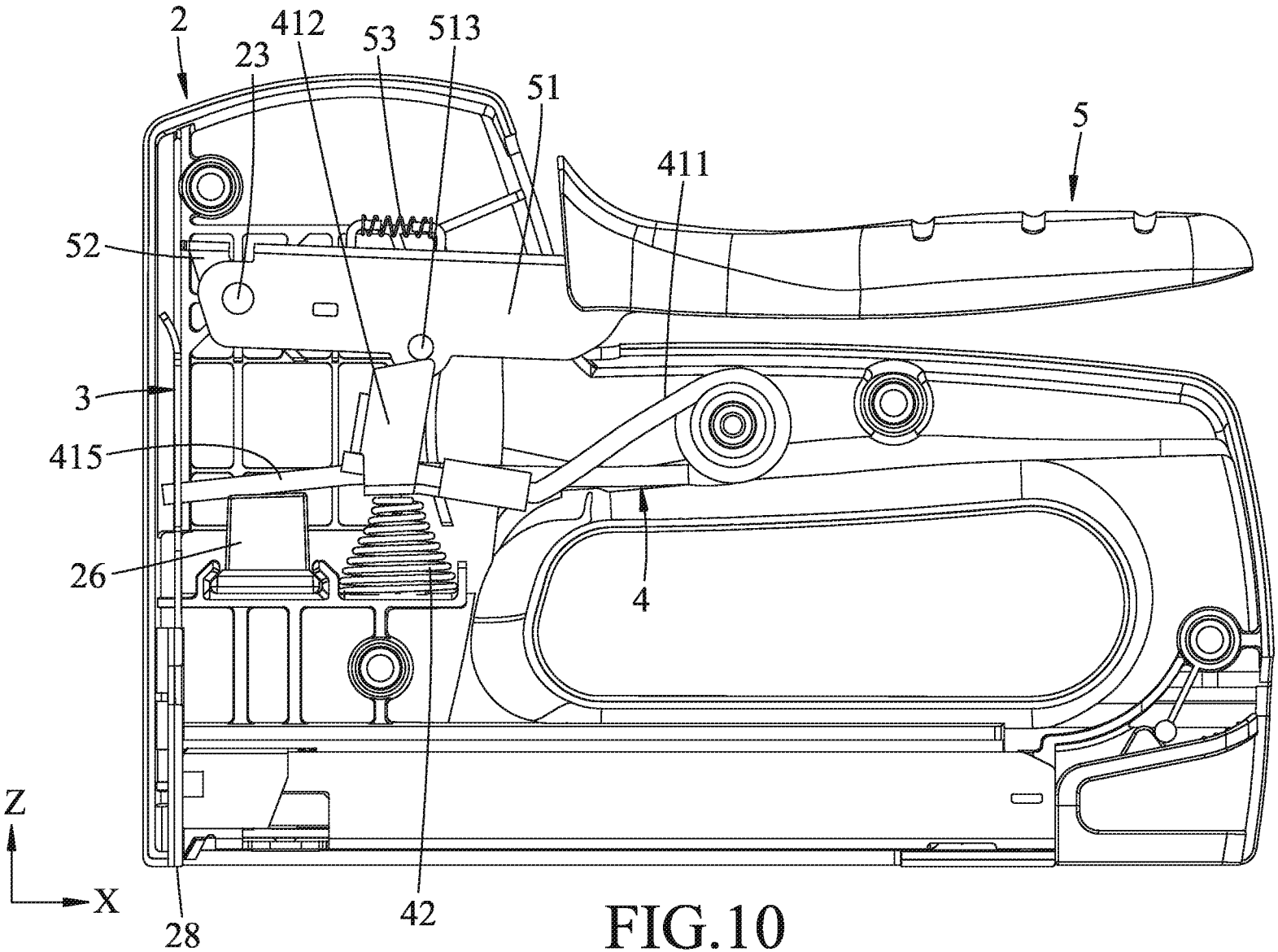
FIG. 10 is a schematic side view of the embodiment, illustrating a state where the handle is in a striking position.

With reference to FIGS. 6 and 10, the handle 51 is pivotally movable relative to the pivot axle 23 between a ready position (see FIG. 6) and a striking position (see FIG. 10). In use, the rear effort end 515 of the handle 51 is pressed downward to pivot the handle 51 from the ready position toward the striking position.

Figure 11:
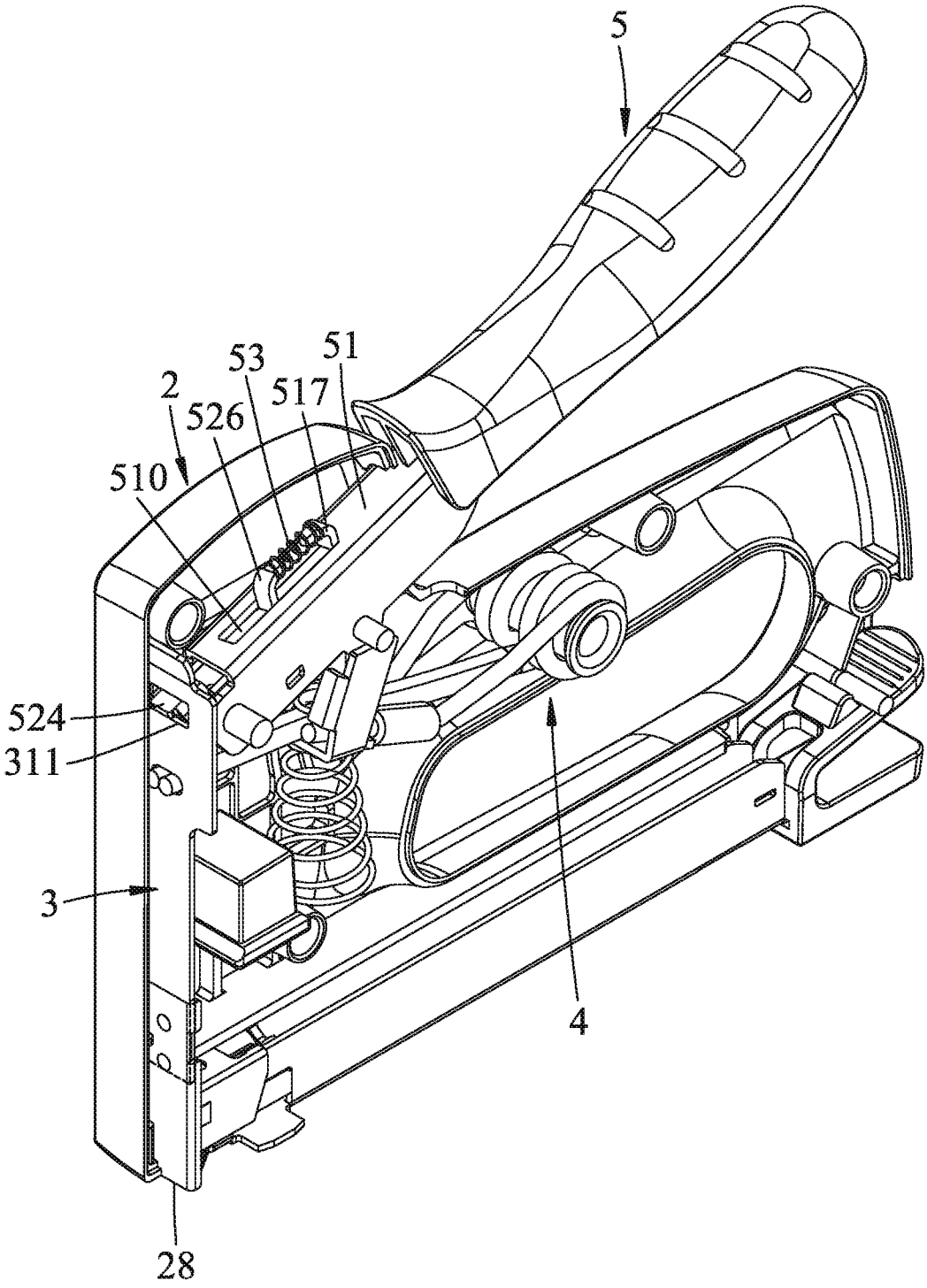
FIGS. 11 to 16 are perspective views of the embodiment, wherein a housing half of the embodiment is removed, and wherein the fastener driving tool during various phases of a fastener driving cycle is illustrated.

Referring to FIGS. 6 and 11, when the handle 51 is in the ready position, the lower striking end 313 of the striking member 3 is in close proximity to the fastening striking opening 28 and the forward anchoring portion 524 of the anchoring member 52 is engaged in the engaged slot 311 of the striking member 3.

Figure 12:
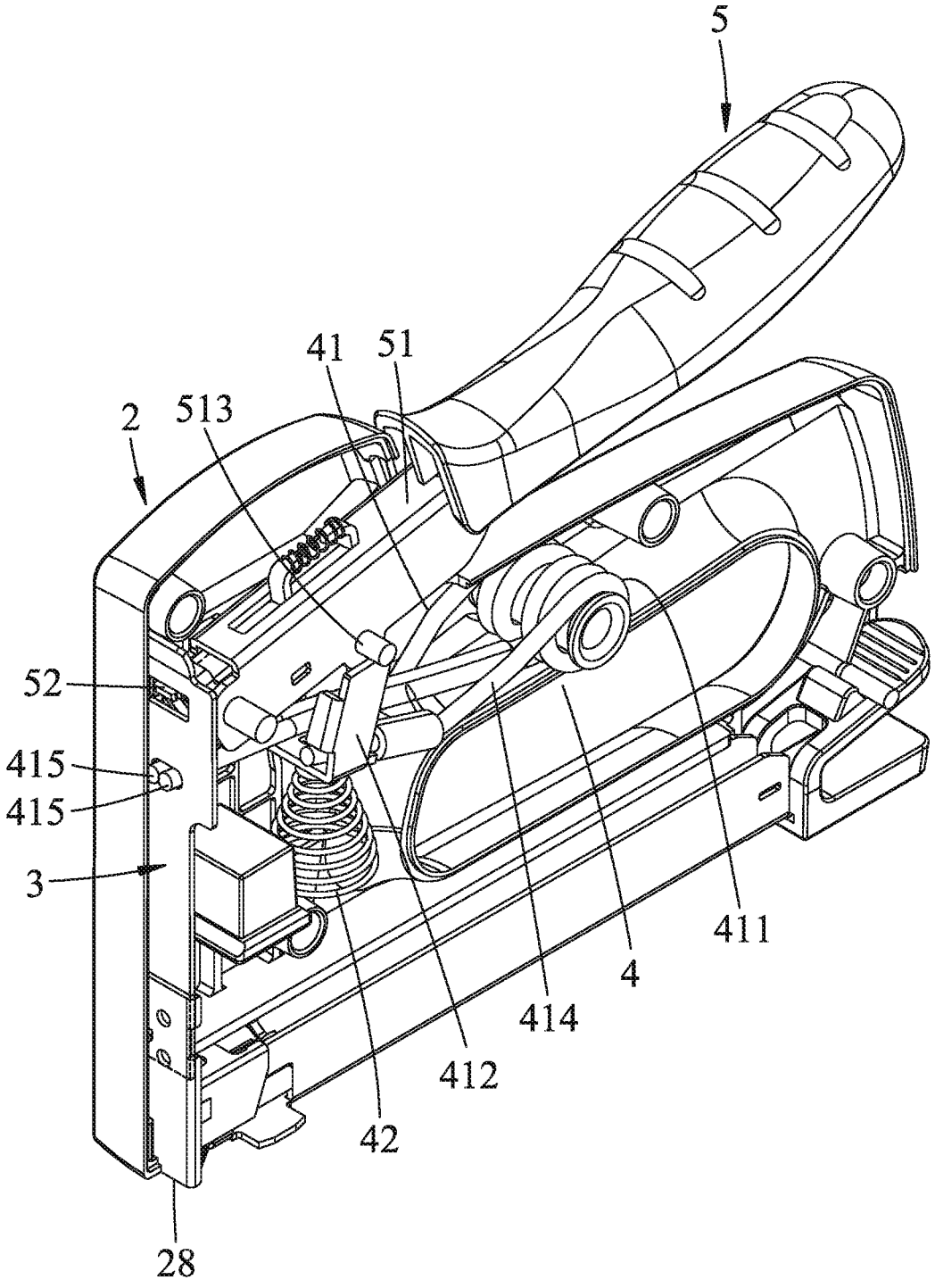

Referring to FIG. 12, during the pivotal movement of the handle 51 from the ready position toward the striking position (i.e., through an intermediate position), via an abutting engagement of the forcing portion 513 with the adaptor 412 and via the short legs 414 of the torsion springs 411 in turn, the adaptor 412 and the short legs 414 are moved downwardly to compress the return spring 42 to generate the return energy, while the anchoring member 52 is moved with the handle 51 for being brought upwardly and rearwardly to engagingly move the striking member 3 and the long legs 415 of the torsion springs 411 upwardly to gradually increase a loading of the torsion springs 411 for the striking member 3.

Figure 13:
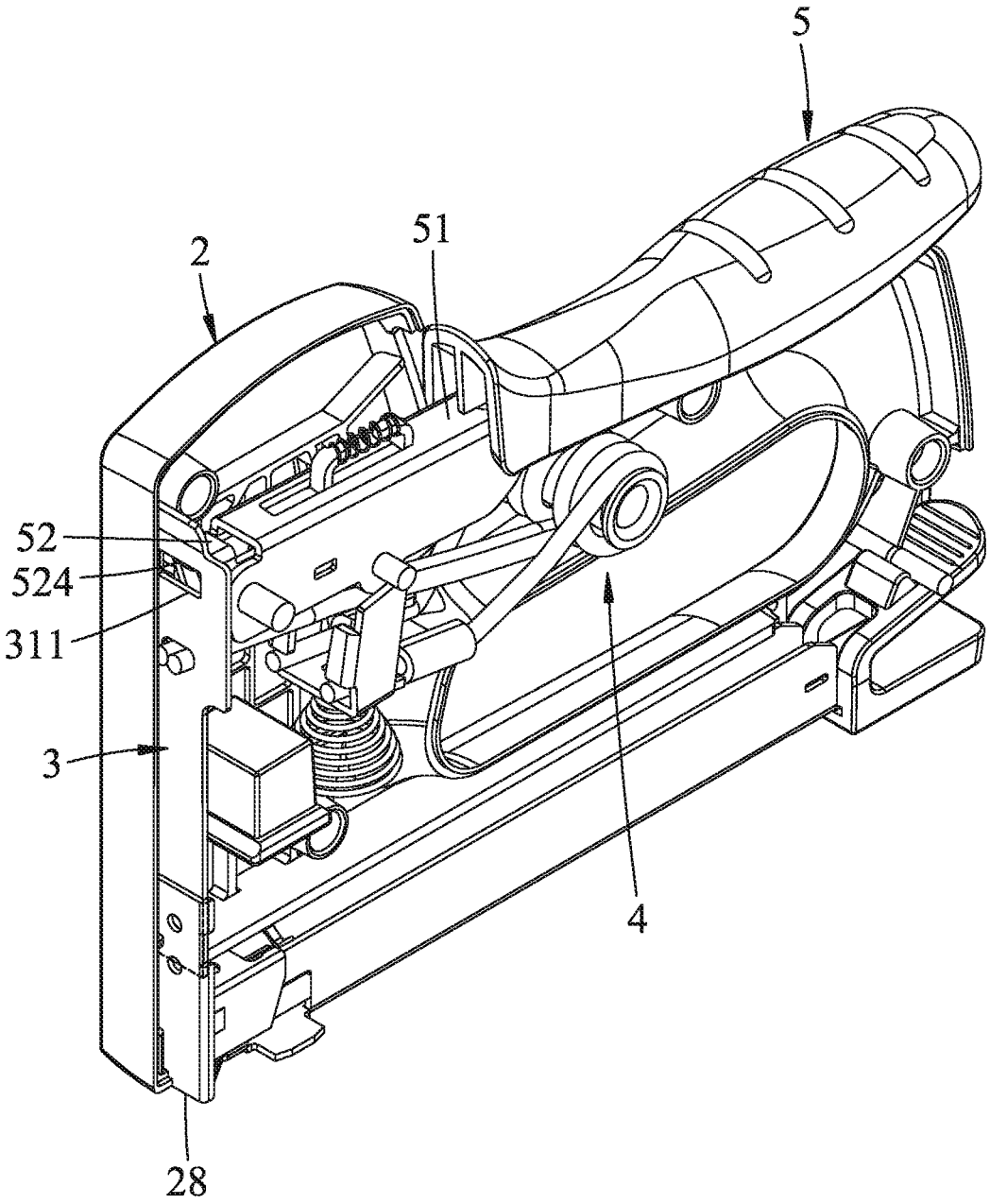
Figure 14:
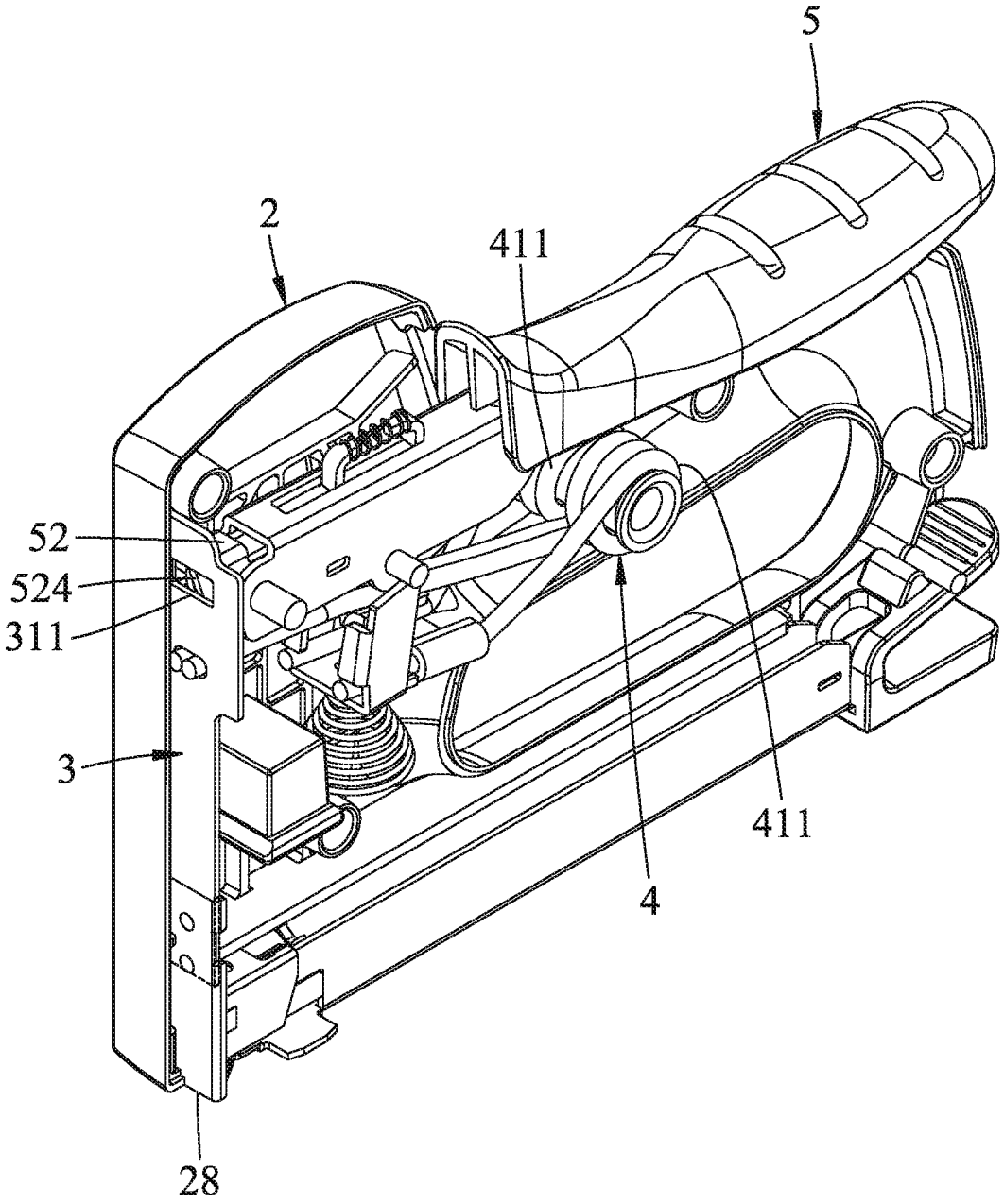
Figure 15:
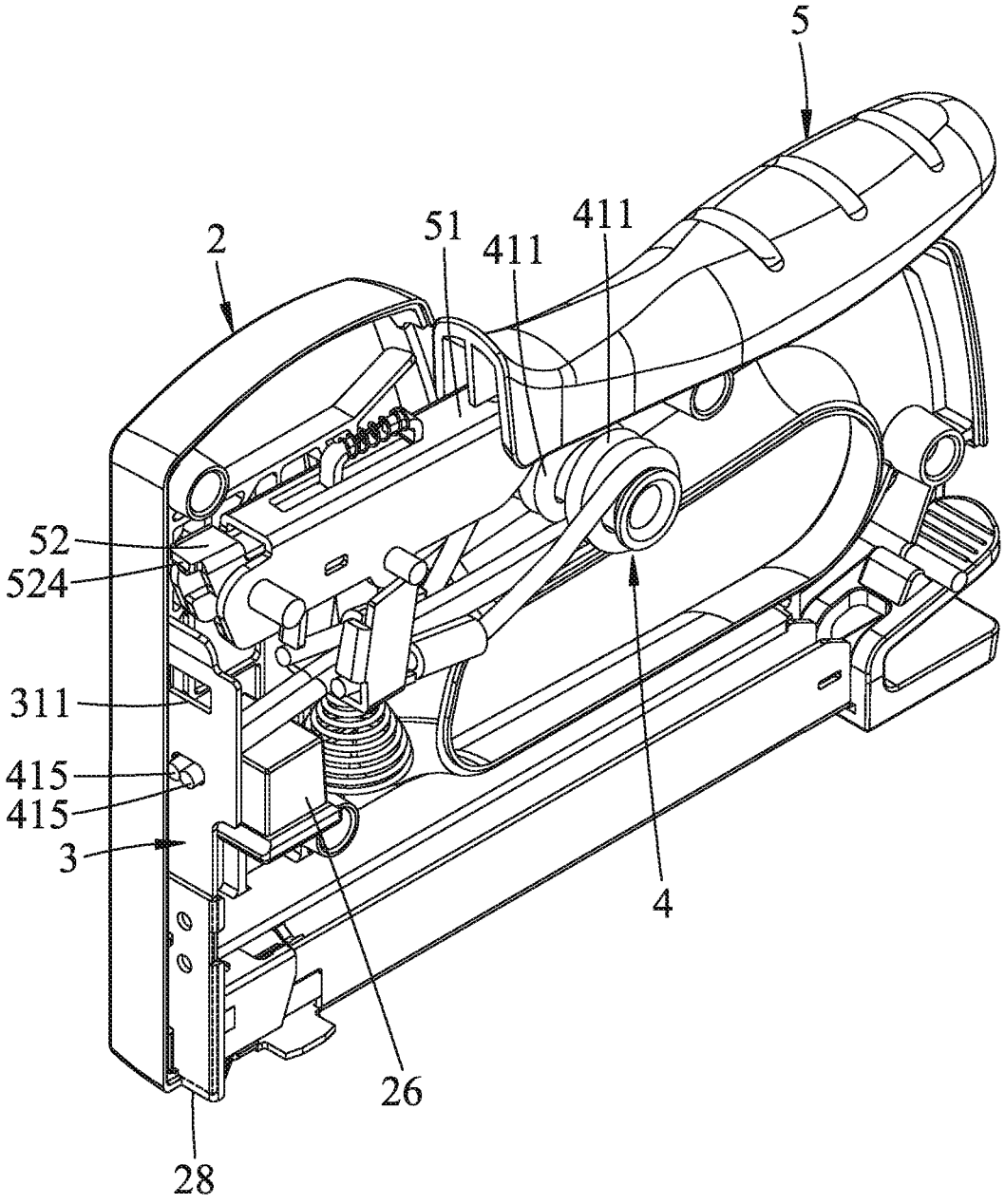

As shown in FIG. 13, once the handle 51 approaches closely to the striking position, the forward anchoring portion 524 of the anchoring member 52 is able to be disengaged from the engaged slot 311 of the striking member 3. Next, in the state as shown in FIG. 14, the anchoring member 52 is being disengaged from the engaged slot 311 of the striking member 3 while the torsion springs 411 remain unmoved. Subsequently, referring to FIGS. 10 and 15, in the striking position, the anchoring member 52 is disengaged from the engaged slot 311 of the striking member 3 while the torsion springs 411 are freed to release a biasing energy to move the striking member 3 downward toward the fastener striking opening 28 by the long legs 415 for performing a fastener striking stroke. At this stage, the downward movement of the long legs 415 is stopped by the stop 26.

Figure 16:
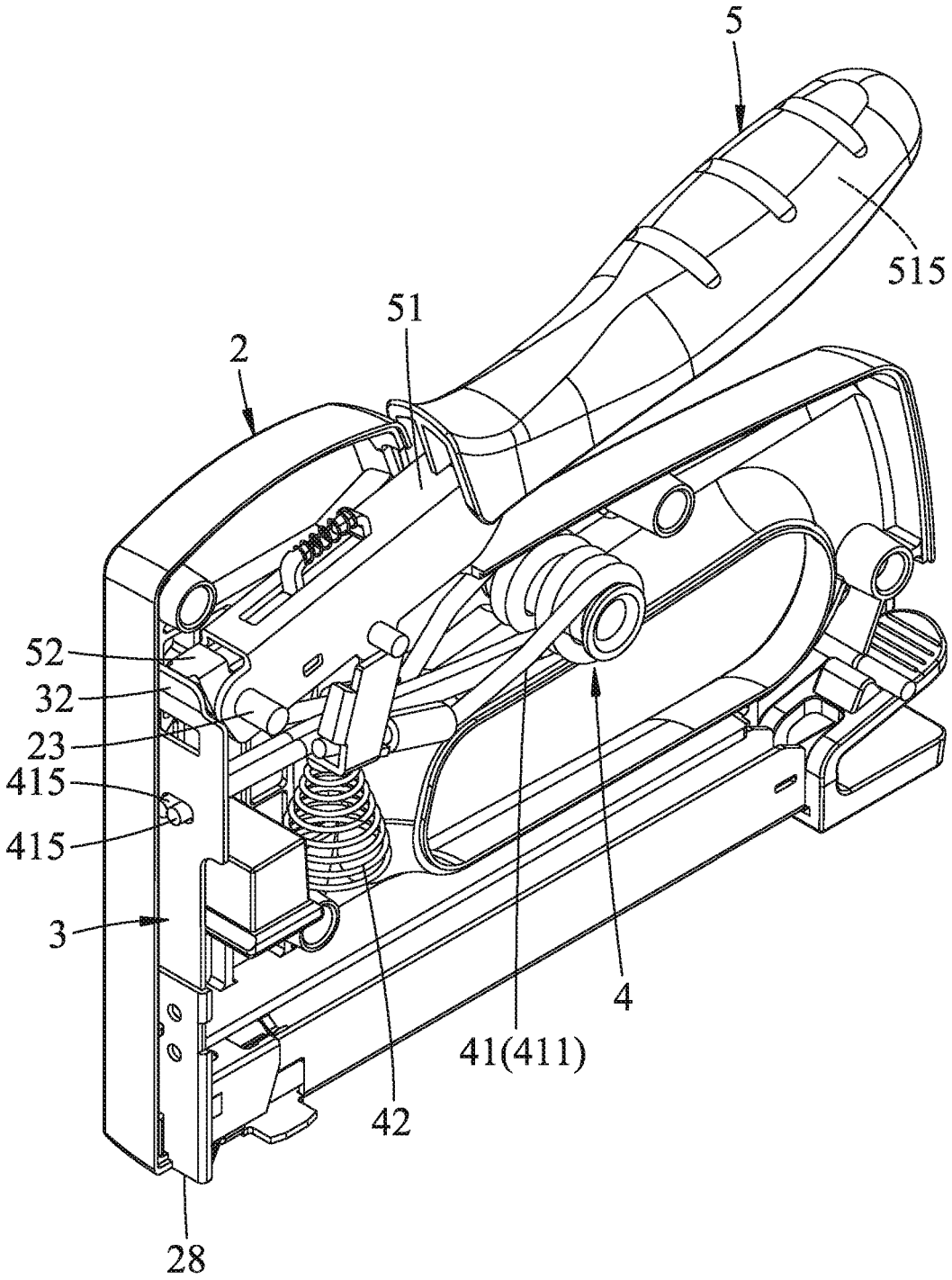
Figure 17:
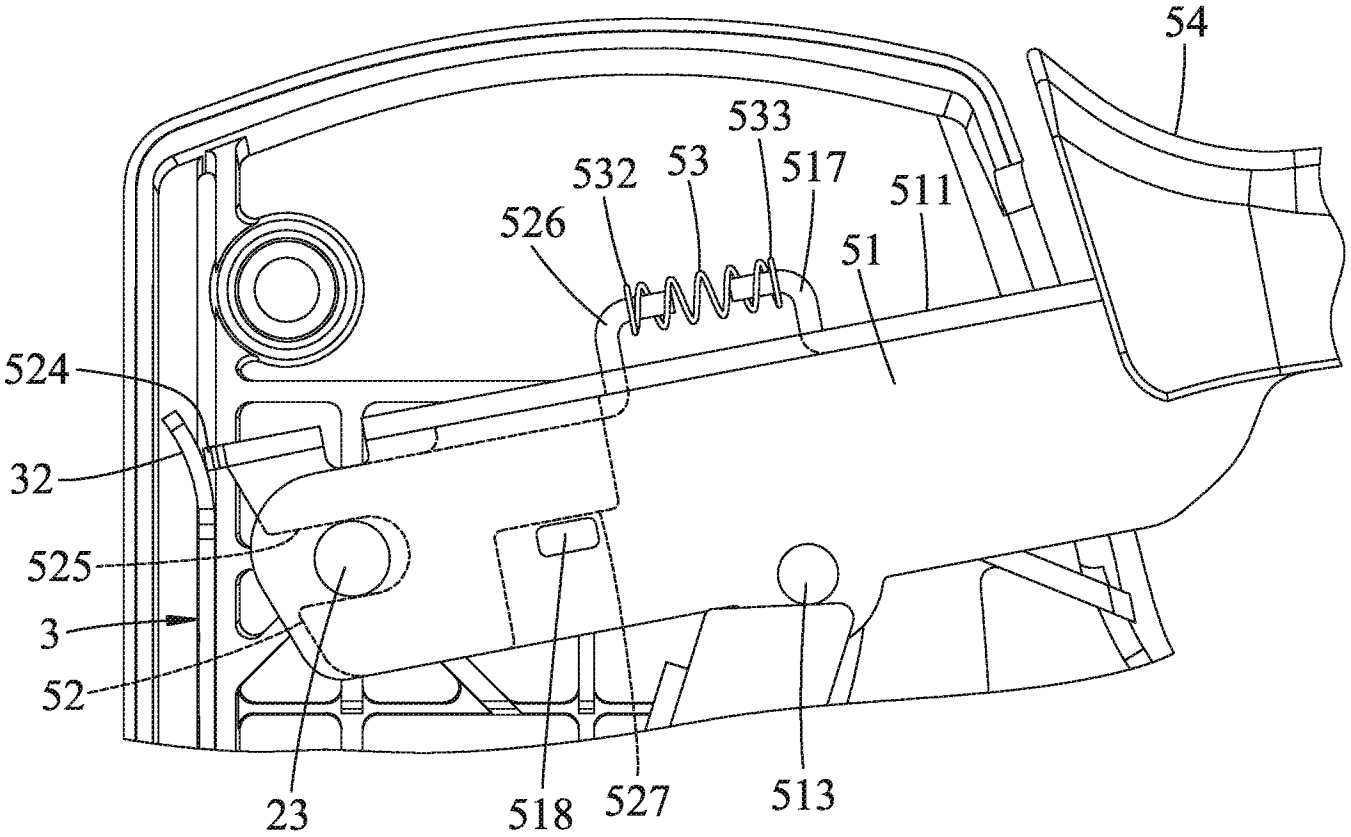
FIG. 17 is a view similar to FIG. 9, illustrating a state where the handle is returned from the striking position to the ready position.

Then, referring to FIGS. 16 and 17, the handle 51 is released from the user, and is returned to the ready position by means of the return spring 42. During a pivotal movement of the handle 51 from the striking position to the ready position, the return spring 42 is freed to release the return energy to urge the energy storing assembly 41 upwardly and to pivot the rear effort end 515 of the handle 51 upwardly and about the pivot axle 23. Meanwhile, the anchoring member 52 is pivotally moved downwardly and about the pivot axle 23. Also, an upward movement of the long legs 415 and the striking member 3 occurs to make a sliding engagement of the striking member 3 with the forward anchoring portion 524 of the anchoring member 52 in the up-and-down direction (Z), while the biasing member 53 is loaded to accumulate a biasing force that urges the anchoring member 52 to be engaged in the engaged slot 311. The sliding member 32 is configured to facilitate the slidable engagement with the forward anchoring portion 524 of the anchoring member 52 to render the pivot movement of the anchoring member 52 about the pivot axle 23 back to the ready position smooth and successful, which in turn loads the biasing member 53. In other words, upon a sliding movement of the forward anchoring portion 524 on the sliding portion 32 of the striking member 3 when the handle 51 is pivotally moved from the striking position to the ready position, the anchoring member 52 is moved rearwardly relative to the handle 51 to compress the biasing member 53 for storing the biasing force.

Figure 18:
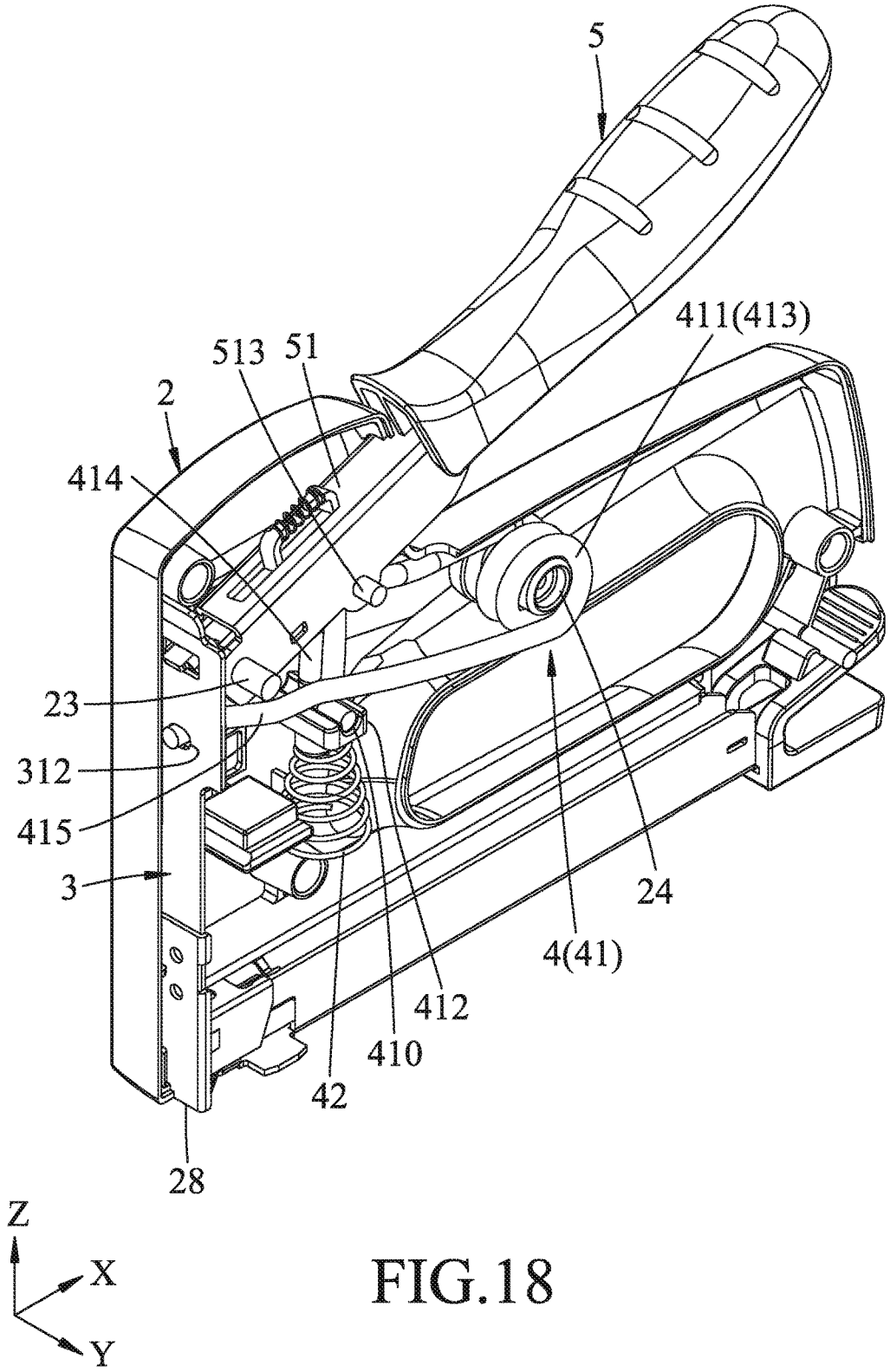
FIG. 18 is a perspective view illustrating another embodiment of the fastener driving tool according to the disclosure, a housing half being removed for the sake of clarity.
Figure 19:
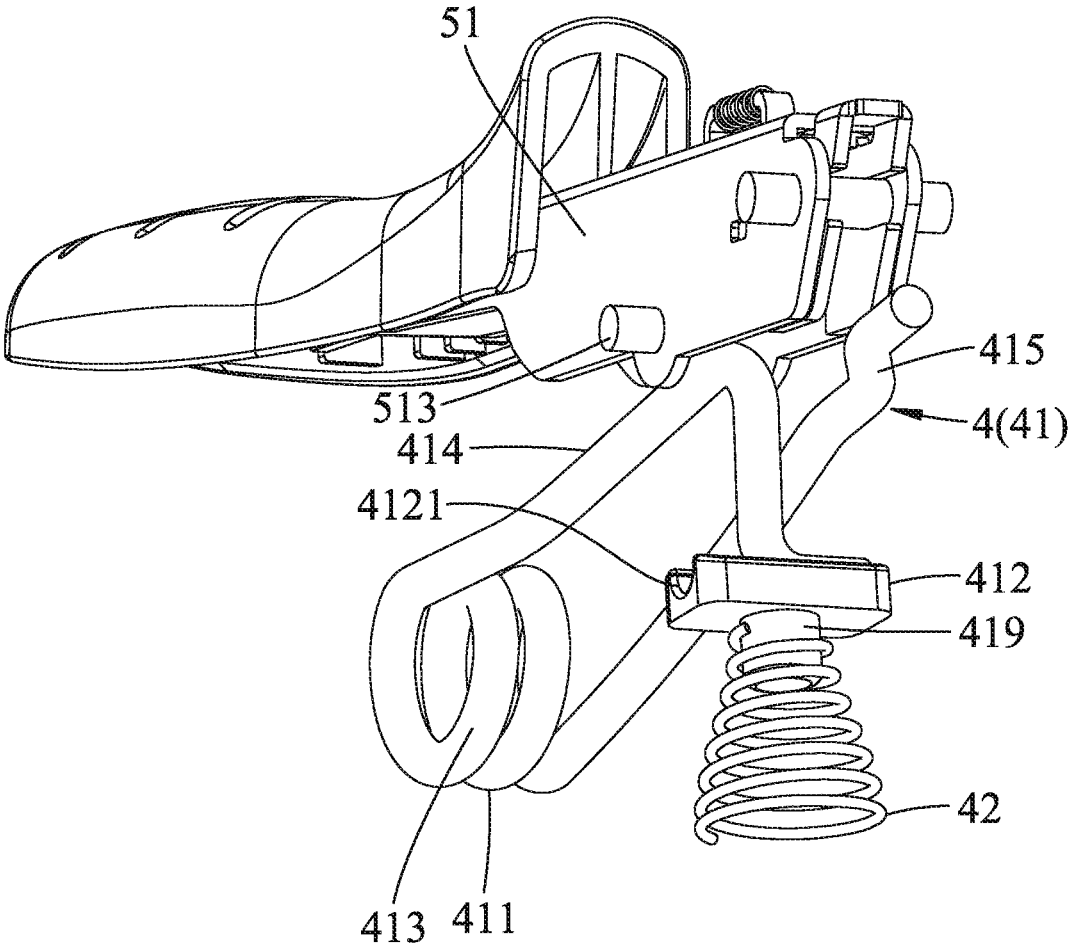
FIG. 19 is a perspective view of a handle unit and an energy storing unit of the embodiment shown in FIG. 18.
Figure 20:
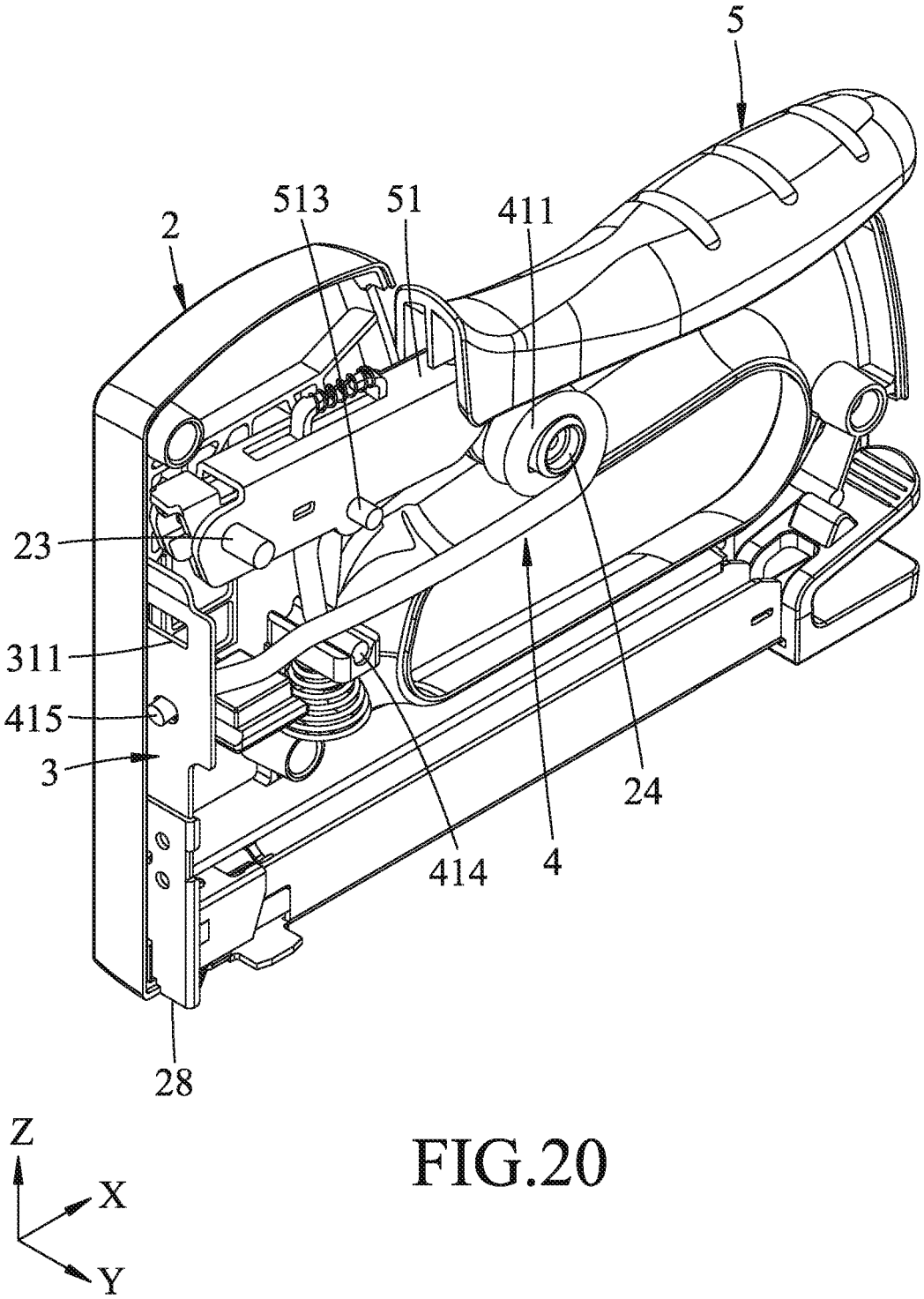
FIG. 20 is a perspective view similar to FIG. 18, illustrating a state where a handle of the handle unit is pressed to a striking position.

Referring to FIGS. 18 and 19, in another embodiment, the energy storing assembly 41 has one torsion spring 411 and the adaptor 412. The torsion spring 411 has a coil 413 sleeved around the fixed axle 24, a short leg 414 extending tangentially and forwardly from the coil 413, and further downwardly and in turn rightwardly, and a long leg 415 extending tangentially and forwardly from the coil 413 and beyond the short leg 414 to be engaged in the connected slot 312 of the striking member 3. The adaptor 412 has an upwardly opened retaining slot 4121 in which a rightwardly extending section of the short leg 414 is retained, and a lower protrusion 419 disposed opposite to the retaining slot 4121 to be connected with an end of the return spring 42. Also, the forcing portion 513 of the handle 51 abuts against the short leg 414. As shown in FIGS. 18 and 20, the handle 51 is pivotable about the pivot axle 23 between the ready position (see FIG. 18) and the striking position (see FIG. 20).

As illustrated, in the disclosure, with the torsion spring(s) 411 having the short and long legs 414, 415 movable in opposite directions to cause a higher degree of twist, a greater energy can be stored in the torsion spring(s) 411 during the pivotal movement of the handle 51 from the ready position to the striking position, and hence the striking member 3 can be moved upwardly in a less distance during the fastener driving cycle, which renders the operation of the handle 51 effortless. With two of the torsion springs 411 arranged in the left-and-right direction, an even stored biasing energy is produced to move the striking member 3 smoothly and successfully. Moreover, with the retaining protrusions 4171 and the stabilizing portions 418 abutting against the front and middle sections of the short legs 414 of the torsion springs 411, the short legs 414 of the torsion springs 411 are firmly retained to the adaptor 412 and the entire structure of the energy storing assembly 41 is strengthened.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A fastener driving tool comprising:

a housing having two housing halves which are matingly engaged with each other to define a housing space, a pivot axle which is disposed in said housing space, and a fastener striking opening at a bottom of a forward end of said housing;

a striking member mounted in said housing for reciprocal movement in an up-and-down direction, said striking member having a lower striking end which faces said fastener striking opening, and an upper driven end which is formed with an engaged slot;

an energy storing unit disposed in said housing space, and including an energy storing assembly which has at least one torsion spring that is twistable about a fixed axle disposed rearwardly of said pivot axle, said torsion spring having a short leg and a long leg which extend tangentially and forwardly, said long leg extending beyond said short leg to engage with said striking member, said energy storing unit further including a return spring which is disposed downwardly of said short leg to be compressed by said short leg to store a return energy; and a handle unit including a handle having a front pivot end which is pivotably mounted in said housing space and on said pivot axle, a rear effort end which is opposite to said front pivot end, and a forcing portion which is interposed between said front pivot end and said rear effort end and which is disposed to force said short leg to move downwardly when said rear effort end is turned about said pivot axle, said handle unit further including an anchoring member which is slidably mounted to said front pivot end of said handle and which has a forward anchoring portion that projects forwardly of said front pivot end to be engaged in said engaged slot of said striking member, and a biasing member which is disposed to bias said anchoring member forwardly such that said handle is pivotally movable relative to said pivot axle from a ready position, where said lower striking end of said striking member is in close proximity to said fastening striking opening and said forward anchoring portion of said anchoring member is engaged in said engaged slot, through an intermediate position, where, via an abutting engagement of said forcing portion with said short leg, said short leg is moved downwardly to compress said return spring to generate the return energy, and where said anchoring member is moved with said handle for being brought upwardly and rearwardly to engagingly move said striking member and said long leg of said torsion spring upwardly to gradually increase a loading of said torsion spring for said striking member, to a striking position, where said anchoring member is disengaged from said engaged slot of said striking member, and said torsion spring is freed to release a biasing energy to move said striking member downward toward said fastener striking opening, and such that, during a pivotal movement of said handle from the striking position to the ready position, said return spring is freed to release the return energy to urge said energy storing assembly upwardly and to cause the pivot movement of said handle and said anchoring member about said pivot axle and an upward movement of said long leg and said striking member to make a sliding engagement of said striking member with said forward anchoring portion of said anchoring member in the up-and-down direction, while said biasing member is loaded to accumulate a biasing force that urges said anchoring member to be engaged in said engaged slot.

2. The fastener driving tool as claimed in claim 1, wherein said energy storing assembly has two of said torsion springs which are sleeved around said fixed axle and arranged in a left-and-right direction, and an adaptor which is fixedly connected to said short legs of said torsion springs and which is configured to permit abutment of said forcing portion of said handle thereagainst.

3. The fastener driving tool as claimed in claim 2, wherein said adaptor has a base wall which is disposed under said torsion springs and on which said short legs of said torsion springs are placed, two side walls which extend upwardly from a periphery of said base wall to respectively terminate at upwardly facing edges and which are spaced apart from each other in the left-and-right direction, two retaining protrusions which extend inwardly toward each other from said side walls, respectively, to cooperate with said base wall to retain said short legs therebetween, and a lower protrusion which extends downwardly from said base wall and on which an end of said return spring is connected, said forcing portion of said handle being configured to abut against said upwardly facing edges in the up-and-down direction.

4. The fastener driving tool as claimed in claim 3, wherein said adaptor has two stabilizing portions which extend upwardly from said periphery of said base wall and which are spaced apart from each other in the left-and-right direction and rearwardly of said side walls, each of said stabilizing portions being configured to firmly retain a middle section of said short leg of said respective torsion spring.

5. The fastener driving tool as claimed in claim 3, wherein said adaptor is formed as an integral single piece to have each of said side walls and said lower protrusion bent from said base wall.

6. The fastener driving tool as claimed in claim 1, wherein said striking member includes a plate body having said lower striking end and said upper driven end, and a sliding member extending upwardly from and deflected forwardly of said upper driven end such that, during the pivotal movement of said handle from the striking position to the ready position, said sliding member is in slidable engagement with said forward anchoring portion of said anchoring member to facilitate the pivot movement of said anchoring member about said pivot axle, which in turn loads said biasing member.

7. The fastener driving tool as claimed in claim 1, wherein said handle has an upper wall formed with an elongated slot which extends in a front-and-rear direction, two side major walls extending downwardly from said upper wall and spaced apart from each other in a left-and-right direction so as to define an elongated sliding space therebetween, and an upper connecting member disposed on said upper wall, each of said side major walls having a pivot hole which is formed at a front end thereof to be sleeved around said pivot axle, and a holding protrusion which is disposed rearwardly of said pivot hole and protrudes laterally toward the other one of said side major walls, said anchoring member being configured to be slidable in said elongated sliding space, and having a sliding guide which is received in and slidable along said elongated slot and which has a tip end that projects upwardly of said elongated slot to be opposite to said upper connecting member, a front notched portion which is rotatably sleeved around said pivot axle, and a rear abutment portion which is disposed to abut against said holding protrusion, said biasing member being a compression spring and having two ends which are respectively engaged with said sliding guide and said upper connecting member such that, when said handle is pivotally moved from the striking position to the ready position, said anchoring member is moved rearwardly relative to said handle upon a sliding movement of said forward anchoring portion on said striking member, to compress said biasing member for storing the biasing force.

8. The fastener driving tool as claimed in claim 1, wherein said housing has a spring bracket disposed in said housing space to hold said return spring, and a stop disposed forwardly of said spring bracket to stop the downward movement of said long leg by the released biasing energy of said torsion spring.

9. The fastener driving tool as claimed in claim 1, wherein said housing has a guiding member disposed in a lower and forward end of said housing space to define a striking track in the up-and-down direction, said fastener striking opening being formed at a lowermost end of said striking track.

10. The fastener driving tool as claimed in claim 1, wherein said handle has a handle sleeve mounted on said handle to cover said rear effort end.

* * * * *